US006099421A

United States Patent [19]

Mayhew

[11] Patent Number: 6,099,421

[45] Date of Patent: Aug. 8, 2000

[54] GOALIE HOCKEY STICK

[76] Inventor: Kent W. Mayhew, 68 Pineglen Cres, Nepean, Ontario, Canada, K2G 0G8

[21] Appl. No.: 09/085,951

[22] Filed: May 28, 1998

[51] Int. Cl.[7] ..... A63B 59/14

[52] U.S. Cl. ..... 473/560; 473/562

[58] Field of Search ..... 473/560–563

[56] References Cited

U.S. PATENT DOCUMENTS

| | | | |
|---|---|---|---|
| 4,340,224 | 7/1982 | Staats | 473/563 |
| 4,544,157 | 10/1985 | Curtis | 273/67 A |
| 4,629,190 | 12/1986 | Borgen | 473/560 |
| 5,456,463 | 10/1995 | Dolan et al. | 273/67 A |
| 5,853,338 | 12/1998 | Ubriaco | 473/562 |

FOREIGN PATENT DOCUMENTS

| | | | |
|---|---|---|---|
| 273438 | 8/1927 | Canada | 473/FOR 189 |
| 088009687 | 12/1988 | WIPO | 473/FOR 189 |

*Primary Examiner*—Mark S. Graham

*Attorney, Agent, or Firm*—Walter W. Duft; Joseph P. Gastel

[57] ABSTRACT

A goalie hockey stick including a shaft, a paddle and a blade which are all rigidly attached wherein the longitudinal axis of the shaft is not parallel to the longitudinal shaft of the paddle. The angle between the longitudinal axis of the shaft and and the longitudinal axis of the blade allows the goalie to more easily handle the puck, allows excessive rotation of the goalie's wrist to be decreased, allows the hockey goalie stick to be less susceptible to breakage and allows the stick to prevent pucks from passing between it and the playing surface when oriented horizontally along the playing surface, without bending or reshaping the shaft.

4 Claims, 2 Drawing Sheets

GOALIE HOCKEY STICK

FIELD OF INVENTION

The present invention relates to improved sticks suitable for use by a goalie in the game of hockey.

BACKGROUND OF THE INVENTION

Conventional goalie hockey sticks comprise a blade, a shaft and a paddle. As used herein, the term "blade" refers to the portion of a hockey stick that contacts the playing surface when the hockey stick is held vertically in the position in which it is normally held by a player during play. As used herein, the term "shaft" refers to the portion of a hockey stick that is normally held by the hockey player during play and extends down to the blade. As used herein, the term "paddle" refers to the portion of a hockey stick typically used by goalies where the shaft is widened and which extends from the heel of the blade to the portion of the shaft where it is typically held by the goalie.

Known goalie sticks are formed by rigidly attaching the shaft to a blade at the heel of the blade and subsequently adding a paddle which serves to widen the lower part of the shaft. In a conventional goalie hockey stick, the longitudinal axis of the paddle is continuous and therefore parallel with the longitudinal axis of the shaft. Further, the edges of the paddle, which are parallel to the longitudinal axis of the paddle, are therefore also parallel to the longitudinal axis of the shaft.

The governing bodies of various hockey leagues generally set guidelines relating to the construction of sticks. Manufacturers of hockey sticks must produce hockey sticks which meet these guidelines if the manufacturers desire their hockey sticks to be used by the players in any such hockey leagues. One such hockey league is the National Hockey League (the "NHL"). According to the guidelines relating to goalie sticks set by the NHL, the length of the shaft of a goalie stick may not exceed 58 inches and the length of the blade may not exceed 15.5 inches. The height of the blade may not exceed 3.5 inches except at the heel where it may not exceed 4.5 inches. The width of the paddle may not exceed 3.5 inches and the length of the paddle may not exceed 26 inches. Conventional goalie hockey sticks generally meet these specifications.

The angle between the shaft and playing surface when the blade is relatively flat on the playing surface, whether it be a goalie or other hockey stick, is generally known as the "lay" or "lie" of the hockey stick. In order that the paddle of the goalie hockey stick stay close to a goalie's leg pads when the blade is relatively flat on the playing surface, the lay of a goalie hockey stick is generally higher than the lay of other hockey sticks. The higher lay means that handling the puck is generally more cumbersome for a hockey player using a goalie hockey stick than for a hockey player using a stick designed for hockey players other than goalies.

Conventional goalie hockey sticks have a straight shaft which extends from the center of the paddle such that the longitudinal axis of the paddle is coincident to the longitudinal axis of the shaft. However, this design can result in unwanted excessive rotation of the wrist of the goalie while the goalie hockey stick is held in a vertical position. This excessive rotation may in turn cause discomfort to the goalie.

Conventional goalie hockey sticks have a shaft and a blade rigidly attached at the heel of the stick wherein the shaft is widened above the heel to form a paddle. As a result of this construction, particularly in the region of the heel of the stick, the stress region where a conventional goalie stick may tend to break upon excessive stress being placed on the blade is across the height of the blade in a region immediately proximal to the heel. As set out above, the height of the blade usually does not exceed 3.5 inches. Therefore, the stress region in a conventional goalie hockey stick is a relatively small area which is highly susceptible to breakage.

Several modifications to the traditional goalie stick have been proposed. For example, U.S. Pat. No. 5,456,463 (Dolan, 1995) and U.S. Pat. No. 4,544,157 (Curtis, 1985) each disclose a goalie hockey stick comprising a shaft with a curved portion near the paddle which serves to place the remaining straight portion of the shaft that extends beyond the paddle nearer to the playing surface when the stick is placed in a horizontal position such that a puck is prevented from passing between the stick and the playing surface. In order to create the curved portion of these sticks, bending and/or reshaping of a straight shaft is required. Such bending and/or reshaping adds further manufacturing steps and increased expense in the production of goalie hockey sticks.

Therefore, it is desirable to have a hockey goalie stick which improves the ease with which a goalie may handle the puck, which allows for a decrease in excessive rotation of the wrist of a goalie, which is less susceptible to breakage and which does not require bending or reshaping of the shaft in order to produce a goalie hockey stick which does not allow the puck to pass between the shaft and a playing surface when the shaft and paddle are placed horizontally proximal to the playing surface.

SUMMARY OF THE INVENTION

Accordingly, it is an object of the present invention to provide a goalie hockey stick which overcomes the aforementioned problems encountered with conventional goalie hockey sticks and the prior art relating thereto.

More specifically, it is an object of the present invention to provide a goalie hockey stick which improves the ease with which a goalie may handle the puck.

It is further object of the present invention to provide a goalie hockey stick which decreases excessive rotation of the wrist of a goalie when the goalie is holding the stick in a vertical position.

It is a further object of the present invention to provide a goalie hockey stick which is less susceptible to breakage when excessive stress is applied to the blade of the stick.

According to one aspect of the present invention, a goalie hockey stick comprises a blade, a paddle having a first longitudinal axis and a shaft having a second longitudinal axis, wherein the blade, paddle and shaft are all rigidly attached and wherein the first longitudinal axis is not parallel to the second longitudinal axis.

According to another aspect of the present invention, the shaft is essentially straight.

According to yet another aspect of the present invention, the angle between the first longitudinal axis and the second longitudinal axis is generally about two to six degrees.

According to yet another aspect of the present invention, the first longitudinal axis and the second longitudinal axis intersect in the paddle.

According to yet another aspect of the present invention, the acute angle between a line tangential to a central portion of a bottom surface of the blade and the first longitudinal axis is greater than the acute angle between the line and the second longitudinal axis.

According to yet another aspect of the present invention, a puck is prevented from passing between either the paddle or the shaft and a playing surface when the paddle and shaft are oriented generally adjacent the playing surface.

According to yet another aspect of the present invention, a method is provided whereby a goalie hockey stick is manufactured by orienting the first longitudinal axis in a position such that it is not parallel to the second longitudinal axis and by subsequently rigidly attaching the shaft and paddle in said position.

The above and other objects, features and advantages of the present invention will become apparent from the following detailed description of preferred embodiment taken in conjunction with the accompanying drawing.

BRIEF DESCRIPTION OF THE DRAWINGS

To further the reader's understanding of the present invention, reference may be had to the accompanying drawings in which.

DETAILED DESCRIPTION OF THE PREFERRED EMBODIMENT

Figure 1:
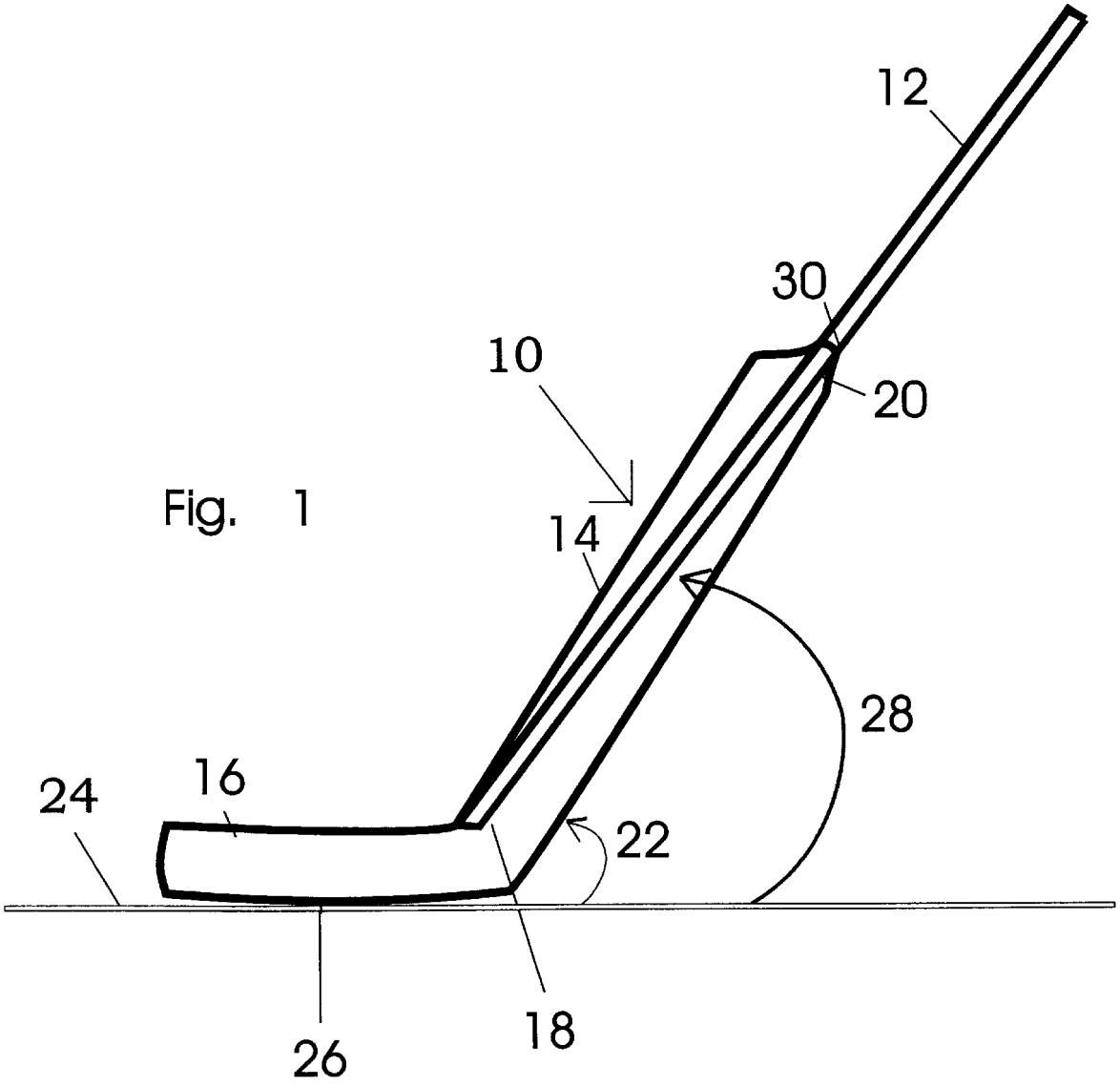
FIG. 1 is a side view of a goalie hockey stick in a vertical position according to an aspect of the present invention.
Figure 2:
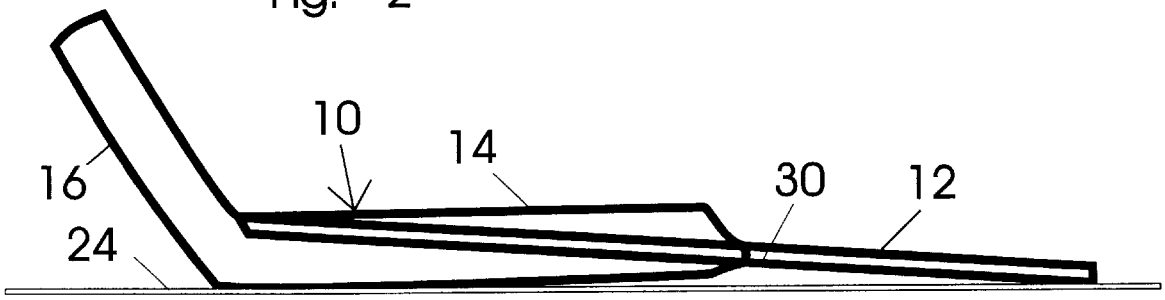
FIG. 2 is a side view of a goalie hockey stick in a horizontal position according to an aspect of the present invention.

The goalie hockey stick 10 shown in FIG. 1 and FIG. 2 is a hockey stick intended to be used by a goalie in the game of hockey.

Those skilled in the art will realize that the game of hockey may include ice hockey, roller hockey, ball hockey and any other variation of the game in which an object such as a puck is moved across a playing surface with the assistance of a stick. A playing surface may include ice or any other surface upon which the game of hockey may be played.

Similarly, the term "puck" as used herein may include a conventional hockey puck, a ball or other object so used in the game of hockey.

The goalie hockey stick 10 as shown in FIG. 1 and FIG. 2, has features similar to those features found in conventional goalie hockey sticks including a shaft 12, a paddle 14, and a blade 16, all of which are rigidly attached. The shaft 12 is essentially straight. By "essentially straight" it is meant that no reshaping or bending of the shaft 12 occurs during the manufacturing process, thus resulting in advantageously lower manufacturing costs for the stick 10.

As indicated in FIG. 1 and FIG. 2, the longitudinal axis of the shaft 12 is not parallel to the longitudinal axis of the paddle 14. The manufacture of the stick 10 is effected by placing the shaft 12 and the paddle 14 together in this non-parallel fashion and subsequently rigidly attaching the shaft 12 and paddle 14 in this position using known techniques. The structural advantage of rigidly attaching the shaft 12 and paddle 14 in this manner is that any stress applied to the rigid attachment of the shaft 12 to the paddle 14 and blade 16, such as a stress transferred from the blade 16 to the location of the rigid attachment, will be spread over the section of the shaft 12 and paddle 14 at the lower portion 18 of the paddle 14 to the upper portion 20 of the paddle 14 as shown in FIG. 1. In this manner, the small area which is highly susceptible to breakage in conventional goalie hockey sticks no longer exists. Instead, the area most susceptible to break is the area along the rigid attachment between the shaft 12 and the paddle 14 identified as being between the lower portion 18 of the paddle 14 and the upper portion 20 of the paddle 14. This area is significantly larger than the small area which is highly susceptible to breakage in conventional goalie hockey sticks. As such, it is advantageously stronger and less likely to break when stress is placed upon the rigid attachment of the shaft 12 to the paddle 14 and blade 16.

Preferably, the angle between the longitudinal axis of the shaft 12 and the longitudinal axis of the paddle 14 is generally about two to six degrees. However, embodiments having angles outside this range may also meet the objects and enjoy the advantages of the present invention. Variation in factors including the length of the shaft 12, the length or width of the paddle 14 and the personal preferences of a goalie will allow for variations in this angle. In the embodiment depicted in FIG. 1 and FIG. 2, these factors are manipulated in the result that the longitudinal axis of the shaft 12 and the longitudinal axis of the paddle 14 intersect in the paddle 14.

In the preferred embodiment depicted in FIG. 1 and FIG. 2 the acute angle 22 between a line (not shown but which is parallel to the top surface of the playing surface 24) tangential to a central portion 26 of a bottom surface of the blade 16 and the longitudinal axis of the paddle 14 is greater than the acute angle 28 between the line and the longitudinal axis of the shaft 12. In light of this configuration of shaft 12 and paddle 14, when a goalie manipulates a puck with the stick 10, the handling of the stick 10 will resemble the handling of a conventional hockey stick used by hockey players other than goalies. Furthermore, when a goalie is defending the net against a shot, the handling of the stick 10 will resemble the handling of a conventional goalie hockey stick. In addition, a more ergonomic handgrip 30 exists allowing a goalie to grip the shaft 12 when holding the stick 10 in a vertical position as shown in FIG. 1, without having to twist his or her wrist as much as would be necessary with a conventional goalie hockey stick.

As shown in FIG. 2, when the stick 10 is placed in a horizontal position such that the shaft 12 and paddle 14 are generally adjacent the playing surface 24 a puck is prevented from passing between the stick 10 and the playing surface 24. Those skilled in the art will realize that the size of the space between the stick 10 and the playing surface 24 when the stick 10 is in this position can be influenced by a variety of factors including the length of the shaft 12, the length and width of the paddle 14 and angle between the longitudinal axis of the shaft 12 and the longitudinal axis of the paddle 14. Preferably, these factors are manipulated to minimize the space between the stick 10 and the playing surface 24 when the stick 10 is positioned horizontally as depicted in FIG. 2.

It will be readily apparent to those skilled in the art of invention that the above-described embodiment provides a goalie hockey stick 10 which improves the ease with which a goalie may handle the puck, which decreases excessive rotation of the wrist of a goalie, which is less susceptible to breakage and which does not require bending or reshaping of the shaft 12 in order to produce a goalie hockey stick 10 which does not allow the puck to pass between the shaft 12 and a playing surface 24 when the shaft 12 and paddle 14 are placed horizontally proximal to the playing surface 24.

Having described the preferred embodiment of the present invention in reference to the drawings, those skilled in the art will appreciate that the invention is not limited to this specific embodiment and that modifications may be made therein without departing from the scope of the present invention as claimed in the following claims.

What is claimed is:

1. A hockey stick having a blade, a paddle having a first longitudinal axis and an essentially straight shaft having a second longitudinal axis, wherein the blade, paddle and shaft are all rigidly attached and wherein the first longitudinal axis is not parallel to the second longitudinal axis and the first longitudinal axis and the second longitudinal axis intersect in the paddle.

2. A hockey stick as claimed in claim 1 wherein the angle between the first longitudinal axis and the second longitudinal axis is generally about two to six degrees.

3. A hockey stick as claimed in claim 1 wherein the acute angle between a line tangential to a central portion of a bottom surface of the blade and the first longitudinal axis is greater than the acute angle between the line and the second longitudinal axis.

4. A hockey stick as claimed in claim 3 wherein a puck is prevented from passing between either the paddle or the shaft and a playing surface when the paddle and shaft are oriented generally adjacent the playing surface.

* * * * *